United States Patent [19]

Maruyama et al.

[11] Patent Number: 5,075,168

[45] Date of Patent: Dec. 24, 1991

[54] POLYAMIDE FILAMENT AND PROCESS FOR PRODUCING THE SAME

[75] Inventors: Seiichiro Maruyama, Fujisawa; Masami Tsunoda, Chigasaki, both of Japan

[73] Assignee: Mitsubushi Kasei Corporation, Tokyo, Japan

[21] Appl. No.: 435,347

[22] Filed: Nov. 13, 1989

[30] Foreign Application Priority Data

Mar. 23, 1989 [JP] Japan ..... 1-71461

[51] Int. Cl.[5] ..... D02G 3/00

[52] U.S. Cl. ..... 428/364; 428/373; 525/432

[58] Field of Search ..... 428/364, 373; 525/432; 528/347

[56] References Cited

U.S. PATENT DOCUMENTS

| | | | |
|---|---|---|---|
| 3,216,965 | 11/1965 | Cipriani | 525/432 X |
| 3,393,252 | 7/1968 | Zimmerman | 525/432 |
| 3,553,288 | 1/1971 | Oda et al. | 525/432 X |
| 3,629,053 | 12/1971 | Kimura et al. | 428/374 |
| 3,843,609 | 10/1974 | Kimura et al. | 428/373 X |
| 4,022,756 | 5/1977 | Chapman et al. | 528/347 X |
| 4,603,166 | 7/1986 | Poppe et al. | 528/347 X |
| 4,617,342 | 10/1986 | Poppe et al. | 528/347 X |

FOREIGN PATENT DOCUMENTS

| | | | |
|---|---|---|---|
| 0073036 | 8/1982 | European Pat. Off. . | |
| 0070001 | 1/1983 | European Pat. Off. | 525/432 |
| 52-85516 | 12/1975 | Japan . | |
| 58-38751 | 8/1982 | Japan . | |
| 62-41261 | 8/1985 | Japan . | |
| 918637 | 2/1963 | United Kingdom | 525/432 |

OTHER PUBLICATIONS

Man-Made Fibers, Science and Technology, vol. 2.

*Primary Examiner*—Lorraine T. Kendell

*Attorney, Agent, or Firm*—Ernest V. Linek

[57] ABSTRACT

Disclosed herein are a polyamide filament comprising a polyamide resin composition which comprises an aromatic polyamide resin (A) produced by polymerizing a monomer containing not less than 85 wt % of an aromatic polyamide component composed of terephthalic acid, isophthalic acid and aliphatic diamine, and an aliphatic polyamide resin (B), and having a heat-shrinkage in boiling water of not less than 20%, and a process for producing the same.

7 Claims, No Drawings

POLYAMIDE FILAMENT AND PROCESS FOR PRODUCING THE SAME

BACKGROUND OF THE INVENTION

The present invention relates to a polyamide filament comprising a specific polyamide resin composition. More particularly, the present invention relates to a polyamide filament which exhibits high heat shrinkage in boiling water and which can be made into a fabric with excellent look and feel. The present invention also relates to a process for producing a polyamide filament exhibiting high heat shrinkage in boiling water comprising melt-spinning a specific polyamide composition and cold stretching the spun filamentous material.

Polyamide filaments which are generally called nylon fibers are easy to dye and have excellent wear-resistance, so that they are widely used for stockings, carpets, etc. However, polyamides which are conventionally used for fabrics are mainly nylon 6 and nylon 66, and the nylon 6/66 copolymer is used only in special cases. The heat-shrinkage in boiling water of any of these nylons is 10 to 15%, so that there is a limited range of applications for such products. It is considered that if it is possible to produce a polyamide fiber exhibiting high heat-shrinkage in boiling water, a new application can be developed in the filed of clothing and the like by, for example, using fibers having different shrinkage for the warp and the weft so as to produce a fiber exhibiting a bulky look and feel.

As one of these methods, Japanese Patent Application Laid-Open (KOKAI) No. 52-85516 (1977) discloses a high heat shrinkable polyamide fiber produced by stretching a filament of a terpolymerized polyamide consisting essentially of hexamethyleneadipamide, hexamethyleneterephthalamide and hexamethyleneisophthalamide and having a glass transition temperature of not lower than 80° C., at a stretching temperature higher than the vicinity of the glass transition temperature. However, the terpolymerized polyamide requires special manufacturing conditions in order to be made into fibers because it is whitened or can not be stretched by cold stretching which is used for ordinary nylon 6, in other words, stretching without any special heating.

Compositions of an aromatic polyamide resin and an aliphatic polyamide resin are shown in Japanese Patent Application Laid-Open (KOKAI) Nos. 58-38751 (1983) and 62-41261 (1987). Although Japanese Patent Application Laid-Open (KOKAI) No. 58-38751 (1983) discloses a composition consisting essentially of an aliphatic polyamide resin, an aromatic polyamide resin and a toughness improving agent, this composition is mainly used in the field of injection molding and only applications of a molded product are shown.

Although Japanese Patent Application Laid-Open (KOKAI) No. 62-41261 (1987) also discloses a composition consisting essentially of an aliphatic polyamide resin. The only use described for this composition is as a biaxially-oriented shrinkable film. Since manufacturing methods and conditions are greatly different between a biaxially-oriented shrinkable film and a filament produced by cold-stretching, one cannot predict with any degree of certainty the shrinkage properties of a filament from the shrinkage properties of a film.

As a result of the present inventors' studies, it has been found that by using a composition of an ordinary aliphatic polyamide resin such as nylon 6 and nylon 66 and a specific aromatic polyamide resin, one can obtain a polyamide filament which may be produced by cold-stretching and which has a high heat-shrinkage in boiling water. The present invention has been achieved on the basis of this finding.

SUMMARY OF THE INVENTION

In a first aspect of the present invention, there is provided a polyamide filament having a heat shrinkage in boiling water of not less than 20% which comprises a polyamide resin composition comprising an aromatic polyamide resin (A) produced by polymerizing a monomer mixture containing not less than 85 wt % of an aromatic polyamide component composed of terephthalic acid, isophthalic acid and aliphatic diamine, and an aliphatic polyamide resin (B), the ratio of the aromatic polyamide resin (A) to the aliphatic polyamide resin (B) being 5/95 to 50/50 by weight ratio.

In a second aspect of the present invention, there is provided a process for producing a polyamide filament having a heat-shrinkage in boiling water of not less than 20%, comprising the steps of:

melt-spinning a polyamide resin composition which comprises an aromatic polyamide resin (A) produced by polymerizing a monomer mixture containing not less than 85 wt % of an aromatic polyamide component composed of terephthalic acid, isophthalic acid and aliphatic diamine, and an aliphatic polyamide resin (B), the ratio of the aromatic polyamide resin (A) to the aliphatic polyamide resin (B) being 5/95 to 50/50 by weight ratio: and cold-stretching the spun filamentous material of polyamide resin composition.

DETAILED DESCRIPTION OF THE INVENTION

The aromatic polyamide resin (A) of the present invention is a polyamide which can form a filament and contains an aromatic group. The aromatic polyamide resin (A) is produced by polymerizing a monomer mixture containing not less than 85 wt % of an aromatic polyamide component composed of terephthalic acid, isophthalic acid and aliphatic diamine. Although the aromatic polyamide resin (A) of the present invention may be a polymer produced from a monomer mixture composed of 100 wt % of the aromatic polyamide component of the present invention, but it may also be a copolymer produced by copolymerizing not less than 85 wt % of the aromatic polyamide component of the present invention and not more than 15 wt % of a monomer mixture composed of a lactam component or another polyamide component composed of an aliphatic dicarboxylic acid and a diamine.

The aliphatic diamine of the present invention is at least one selected from the group consisting of ethylenediamine, tetramethylenediamine, hexamethylenediamine, octamethylenediamine, decamethylenediamine and the derivatives of these compounds with the methylene groups methylated, ethylated or halogenated.

As examples of a lactam used in the production of the copolymer, caprolactam and lauryllactam may be exemplified. As examples of diamine used in the production of the copolymer, 2,2-bis(4-amino-3-methylcylcohexyl)propane, methaxylylenediamine and isophoronediamine as well as the above-described aliphatic diamines may be exemplified. As the aliphatic dicarboxylic acid used in the production of the copolymer, aliphatic carboxylic acids such as succinic acid, glutaric acid, adipic acid, pimrlic acid, suberic acid, azelaic acid and sebacic acid and the derivatives of these compounds with the methylene groups methylated, ethylated or halogenated, and a mixture thereof may be exemplified.

As another polyamide component, a nylon salt produced from the above-described diamine and the aliphatic dicarboxylic acid in advance is also usable.

The glass transition temperature of the aromatic polyamide resin (A) of the present invention is different depending upon the ratio of terephthalic acid and isophthalic acid, and the kind and the amount of the copolymer component, but it is preferably 80° to 180° C. and more preferably 100° to 160° C. The glass transition temperature is measured as the temperature at which the elasticity modulus (E') rapidly changes in the measurement of viscoelasticity by Bibron. If the glass transition temperature is lower than 80° C., the fibers are apt to be stuck to each other during dying when the mixing amount of aromatic polyamide resin (A) is large. On the other hand, if the glass transition temperature is higher than 180° C., stretching at a low temperature becomes difficult.

The ratio of terephthalic acid to isophthalic acid is 1/1.5 to ⅓ by weight ratio, preferably 1/1.8 to 1/2.8 by weight ratio. If the ratio falls outside this range (above or below), the desired heat-shrinkage property is either decreased or lost completely.

The melt-viscosity of the aromatic polyamide resin (A) of the present invention is 1,000 to 10,000 poise at 280° C., preferably 2,000 to 8,000 poise at 280° C. If the melt-viscosity is lower than 1,000 poise, the mechanical property of the filament deteriorates. If the melt-viscosity is more than 10,000 poise, it is necessary to raise the melting temperature at the time of melt spinning, and as a result one or more disadvantages may occur, such as the high possibility of thermal decomposition of the polyamide, and/or the deterioration of mechanical properties.

As an aliphatic polyamide resin (B) of the present invention, a polyamide obtained by the polymerization of a lactam of six- or more-membered ring, polymerizable ω-amino acid, dibasic acid, diamine, etc. are usable. More concretely, polymers obtained by the polymerization of a monomer of ε-caprolactam, aminocaproic acid, enanthocaprolactam, 7-aminoheptanoic acid, lauryllactam, 11-aminoundecanoic acid, α-pyrrolidone and α-piperidone; polymers obtained by the polycondensation of a diamine such as hexamethylenediamine, nonamethylenediamine, undecamethylenediamine, dodecamethylenediamine and methaxylylene diamine with a dicarboxylic acid (it may contain a small amount of terephthalic acid or isophthalic acid, if necessary) such as adipic acid, sebacic acid, dodecanoicdibasic acid and glutaric acid; and the copolymers thereof are usable. Among these, homopolymers and copolymers obtained by the polymerization of a monomer containing not less than 85 wt % of the above-described aliphatic lactam, ω-amino acid, dibasic acid or a diamine are preferable. For example, nylons 4, 6, 7, 8, 11, 12, 66, 69, 610, 611, 612, 6/66, 6/12, 6/6T are preferable. Nylon 6 and nylon 66 are particularly preferable from the point of view of cost. From the point of view of shrinkage, nylon 6/66 and nylon 6/6T (containing not more than 15 wt % of 6T ingredient) are preferable.

The relative viscosity of 98% sulfuric acid solution of the aliphatic polyamide resin (B) of the present invention, measured at 25° C. is preferably 2.0 to 3.5, more preferably 2.2 to 3.0. If the relative viscosity is lower than 2.0, the mechanical strength becomes insufficient, while if it is higher than 3.5, the extrusion property during melt spinning is bad.

In the polyamide resin composition of the present invention, the ratio of the aromatic polyamide resin (A) to the aliphatic polyamide resin (B) is (A)/(B)=5/95 to 50/50 by weight ratio, preferably (A)/(B)=10/90 to 45/55 by weight ratio. If the aliphatic polyamide resin (B) exceeds this range, the desired improvement in heat-shrinkage does not occur. If it is less than this range, not only does stretching becomes difficult but also whitening (blushing) may occur during cold-stretching.

In the present invention, if the amount of aromatic polyamide resin (A) is comparatively large, the glass transition temperature of the aromatic polyamide resin (A) is relatively low, or a copolymer having a low crystallinity is used as the aliphatic polyamide resin (B), unstretched filaments are sometimes stuck to each other, causing difficulties during the stretching process. To prevent this, in the present invention, not more than 0.5 wt %, more preferably 0.05 to 0.3 wt % of an aliphatic bis-amide compound represented by the following general formula (I) or (II) based on the total amount of the aromatic polyamide resin (A) and the aliphatic polyamide resin (B) may be further mixed.

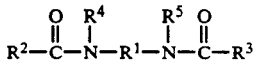

(I)

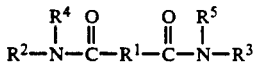

(II)

(wherein $R^1$ represents a divalent hydrocarbon residue having 1 to 18 carbon atoms, $R^2$ and $R^3$ each represent a univalent hydrocarbon residue having 12 to 22 carbon atoms, and $R^4$ and $R^5$ each represent a hydrogen atom or a univalent hydrocarbon residue having 1 to 3 carbon atoms.)

Examples of a bis-amide compound represented by the general formula (I) are alkylene bisfatty amides, arylene bisfatty amides and arylendialkylene bisfatty amides obtained by the reaction of a diamine represented by an alkylenediaiine such as methylenediamine, ethylenediamine, propylenediamine, butylenediamine, hexamethylenediamine, octamethylenediamine and dodecamethylenediamine: an arylendiamine such as phenylenediamine and naphthylenediamine; and an arylenedialkyldiamine such as xylylenediamine, and a fatty acid such as stearic acid, hexanoic acid, octanoic acid, decanoic acid, lauric acid, myristic acid, palmitic acid, arachidic acid, behenic acid, oleic acid, elaidic acid and montanic acid. Among these, N,N'-methylene bisstearic amide and N,N'-ethylene bisstearic amide are preferable.

A bis-amide compound represented by the general formula (II) is obtained by the reaction of a monoamine represented by an alkylamine such as ethylamine, methylamine, butylamine, hexylamine, decylamine, pentadecylamine, octadecylamine and dodecylamine; an arylamine such as aniline and naphthylamin; an arakylamine such as benzylamine; and a cycloalkylamine such as cyclohexylamine, and a dicarboxylic acid such as terephthalic acid, p-phenylendipropionic acid, succinic acid and adipic acid. Among these, dioctadecyldibasic amides such as N,N'-dioctadecylterephthalic amide are preferable.

These bis-amide compounds may be used either singly or in the form of a mixture.

A polyamide resin composition of the present invention may contain additives which are generally mixed with a polyamide, for example, a coloring agent such as a dye and a pigment, an antioxidant, a light-resisting agent, an anti-static agent and a lubricant as well as the above-described ingredients within the range which does not impair the object of the present invention.

The heat-shrinkage of a polyamide filament of the present invention in boiling water is not less than 20%, preferably not less than 25%.

A polyamide filament of the present invention is produced, for example, by the following method.

A filamentous material is extruded from a spinneret at a temperature in the range of from not lower than the melting points of both polyamides (A) and (B) to not higher than 300° C., and is received by pins provided below the spinneret, thereby melt. spinning. The spun filamentous material is immediately, wound around a drum or a bobbin so as to form a filamentous package. Alternatively, the obtained filamentous material is subjected to direct stretching process before the winding process to obtain a package of a polyamide filament. After the cooling and solidification process and before the winding process, the filamentous material is generally treated by an aqueous emulsion such as vegetable oil and mineral oil containing an antistatic agent so as to prevent the filamentous material from becoming wet and being charged with static electricity or to bundle the filaments. The thus-produced unstretched yarn is then subjected to cold-stretching process in which the yarn is stretched to 2 to 5 times.

The stretching temperature is preferably 10° to 60° C., more preferably 15° to 50° C.

The polyamide composition of the present invention affords, by cold-stretching, a polyamide filament exhibiting excellent properties.

The thus obtained polyamide filament according to the present invention shows a heat-shrinkage in boiling water of not less than 20%, preferably not less than 25%, a tensile strength of not less than 3.5 g/d, preferably not less than 3.9 g/d, a tensile elongation of not less than 42%, preferably 45 to 70%, a knot strength of not less than 3.8 g/d, preferably not less than 4.0 g/d and a knot elongation of not less than 50%, preferably 54 to 75%.

Namely, according to the present invention, it is possible to produce a polyamide filament having a very high heat-shrinkage in boiling water with the same productivity as in the case of the existing nylon yarns. It is possible to produce a mixed yarn having an excellent latent heat-shrinkage in boiling water by combining a fiber of a homopolyamide having a low heat-shrinkage in boiling water, with different types of polyamides or a polyester fiber with a polyamide filament of the present invention.

In addition, it is possible to industrially produce a composite yarn having an excellent latent crimping property by using such a composite spun yarn.

Furthermore, it is possible to expand the uses of polyamide resins in the clothing field to produce fabrics having various qualities of look and feel.

The present invention will be more precisely explained while referring the Examples which follow.

However, the present invention is not restricted to the Examples below. From the foregoing description, one skilled in the art can easily ascertain the essential characteristics of this invention, and without departing from the spirit and scope thereof, can make various changes and modifications of the invention to adapt it to various usages and conditions.

In the following examples, the measurement of the heat-shrinkage in hot-water was carried out by obtaining the shrinkage of a yarn in the machine direction after it had been treated in boiling water of 98° C. for 30 minutes in accordance with JIS L1013.

The tensile strength, elongation, the knot strength and elongation were also measured in accordance with JIS L1013.

REFERENCE EXAMPLE

Process for producing aromatic polyamide resin (A)

13.9 kg of aqueous hexamethylenediamine solution (80 wt %), 9.8 kg of isophthalic acid and 4.9 kg of terephthalic acid were added to 53 kg of distilled water, and uniformly stirred and dissolved therein. 65 g of acetic acid was further added and the resultant mixture was charged into an autoclave. Water was distilled off until the concentration of the nylon salt reached 90 wt % while maintaining the pressure at 2.5 kg/cm$^2$. When the internal temperature reached 250° C., the inner pressure was slowly reduced. The reaction product was further polymerized under a vacuum of 660 torr for 1 hour and then extruded into pellets. The melt viscosity of the thus-obtained polymer at 280° C. was 4000 poise and the weight ratio of terephthalic acid to isophthalic acid was ½. The glass transition temperature was 126° C.

EXAMPLE 1

25 parts by weight of the aromatic polyamide resin (A) obtained in Reference Example and 75 parts by weight of an aliphatic polyamide resin (B) (nylon 6; relative viscosity: 2.5; melting point: 224° C.) were dry blended and the resultant mixture was spun from the spinneret provided with 36 holes at 275° C. by an ordinary melt spinning machine. The spun filamentous material was wound around a drum after a lubricant containing 85% of water was adhered thereto with a rotary roller, thereby obtaining a package of unstretched filaments of 420 denier. The obtained filaments were separated and cold-stretched at a room temperature at a stretching ratio of 3.25, thereby obtaining a stretched yarn of 36 filaments and 140 denier without any trouble such as breaking. Various properties of the thus-obtained stretched filament were measured. The results are collectively shown in Table 1.

EXAMPLE 2

A yarn was obtained by the same melt spinning and stretching as in Example 1 except that 0.1 part by weight of N,N'-ethylene bisstearic amide was added to the mixture of the aromatic polyamide resin (A) and the aliphatic polyamide resin (B). Various properties of the thus-obtained stretched filament were measured. The results are shown in Table 1.

COMPARATIVE EXAMPLE 1

A package of unstretched filaments was obtained by the same melt spinning stretching as in Example 1 except for singly using the aromatic polyamide resin (A) obtained in Reference Example. Although cold-stretching was attempted on the unstretched filaments as in Example 1, they were so frequently broken that stretching was impossible. The filaments were stretched by hot pins of 100° C. and then continuously thermoset while stretching by using hot plates of 150° C. The stretching ratio was 2.0. Stretching at a further stretching ratio was impossible. Various properties of the thus-obtained stretched filament were measured. The results are shown in Table 1.

COMPARATIVE EXAMPLE 2

A yarn was obtained by the same melt spinning and cold stretching as in Example 1 except for singly using the aromatic polyamide resin (B). Various properties of the thus-obtained stretched filament were measured. The results are shown in Table 1.

EXAMPLE 3

20 parts by weight of the aromatic polyamide resin (A) obtained in Reference Example and 80 parts by weight of an aliphatic polyamide resin (B) (nylon 6; relative viscosity: 2.3; melting point: 224° C.) were dry blended and the mixture was spun from the spinneret provided with 24 holes at 250° C. by an ordinary melt spinning machine. The obtained filaments were cold-stretched at a room temperature at a stretching ratio of 3.5, thereby obtaining a stretched yarn of 24 filaments and 80 denier. The results of various properties of the thus obtained filament are shown in Table 1.

EXAMPLE 4

A yarn was obtained in the same way as in Example 1 except for changing the composition into 10 wt % of the aromatic polyamide resin (A) and 90 wt % of the aliphatic polyamide resin (B). Various properties of the thus-obtained stretched filament were measured. The results are shown in Table 1.

EXAMPLES 5 AND 6, COMPARATIVE EXAMPLES 3 AND 4

Polyamide compositions were produced by using the aromatic polyamide resin (A) obtained in Reference Example and an aliphatic polyamide resin (B) (nylon 6; relative viscosity: 3.5; melting point: 224° C.) having the compositions shown in Table 1. The respective polyamide compositions were extruded at an extruding temperature of 265° C. and thereafter cooled to 12° C. with water. The polyamide compositions were then cold-stretched at room temperature to obtain monofilaments of 90 denier. The respective stretching ratios are shown in Table 1 together with various properties.

In Comparative Example 4, cold-stretching was attempted at a stretching ratio similar to those in Examples 5 and 6, but cold-stretching was difficult due to a trouble such as breaking. The polyamide composition was, therefore, cold-stretched at a ratio of 2.6. The filament obtained was so weak that measurement of the properties such as the tensile strength was impossible.

TABLE 1

| | Composition (weight ratio) (A)/(B) | Stretching ratio (time) | Fineness of stretched yarn | Tensile strength (g/d) | Tensile elongation (%) | Knot strength (g/d) | Knot elongation (%) | Heat-shrinkage (%) |
|---|---|---|---|---|---|---|---|---|
| Example 1 | 25/75 | 3.25 | 36 (filaments) 140 (denier) | 4.5 | 46.3 | — | — | 38.0 |
| Example 2 | 25/75 | 3.25 | 36 (filaments) 140 (denier) | 4.6 | 45.5 | — | — | 37.5 |
| Comp. 3 | 100/0 | 2.0 | 36 (filaments) 140 (denier) | 2.3 | 47.6 | — | — | 5.1 |
| Comp. 2 | 0/100 | 3.25 | 36 (filaments) 140 (denier) | 5.0 | 41.0 | — | — | 11.6 |
| Example 3 | 20/80 | 3.5 | 24 (filaments) 80 (denier) | 4.9 | 51 | — | — | 27 |
| Example 4 | 10/90 | 3.5 | 24 (filaments) 80 (denier) | 4.9 | 50 | — | — | 21 |
| Comp. 3 | 0/100 | 4.25 | mono-filament 90 (denier) | 5.1 | 46 | 4.6 | 36 | 10 |
| Example 5 | 20/80 | 4.25 | mono-filament 90 (denier) | 5.3 | 56 | 5.1 | 54 | 22 |
| Example 6 | 40/60 | 4.0 | mono-filament 90 (denier) | 3.9 | 60 | 4.0 | 63 | 25 |
| Comp. 4 | 60/40 | 2.6 | mono-filament 90 (denier) | — | — | — | — | 9 |

What is claimed is:

1. A polyamide filament comprising a mixture of aromatic and aliphatic polyamide resins, said mixture comprising an aromatic polyamide resin (A) produced by polymerizing a monomer mixture comprising not less than 85 wt % of an aromatic polyamide component composed of terephthalic acid, isophthalic acid and aliphatic diamine, and an aliphatic polyamide resin (B) selected from the group consisting of nylon 6 and a copolymer which is mainly composed of nylon 6, the ratio of said terephthalic acid to said isophthalic acid in said monomer mixture ranging from about 1:1.5 to 1:3 the ratio of said aromatic polyamide resin (A) to said aliphatic polyamide resin (B) in said mixture ranging from about 5:95 to about 50:50 by weight ratio; and said filament exhibiting heat-shrinkage in boiling water of not less than 20%.

2. A polyamide filament according to claim 1, wherein said monomer mixture consists essentially of said aromatic polyamide component.

3. A polyamide filament according to claim 1, wherein said monomer mixture comprises not less than 85 wt % of said aromatic polyamide component and not more than 15 wt % of a component selected from the group consisting of a lactam component and a polyamide component composed of an aliphatic dicarboxylic acid and a diamine.

4. A polyamide filament according to claim 3, wherein said monomer mixture comprises not less than 85 wt % of said aromatic polyamide component and not more than 15 wt % of a lactam component.

5. A polyamide filament according to claim 1, wherein said copolymer is a polymer selected from the group consisting of nylon 6/66 and nylon 6/6T.

6. A polyamide filament according to claim 1, wherein said polyamide resin (B) is nylon 6.

7. A polyamide filament according to claim 1, wherein said aliphatic diamine is hexamethylenediamine.

* * * * *